US006006840A

United States Patent [19]

Sundholm

[11] Patent Number: 6,006,840

[45] Date of Patent: Dec. 28, 1999

[54] FIRE EXTINGUISHING SYSTEM

[76] Inventor: Göran Sundholm, Ilmari Kiannon kuja 3, 04310 Tuusula, Finland

[21] Appl. No.: 09/125,905

[22] PCT Filed: Mar. 10, 1997

[86] PCT No.: PCT/FI97/00156

§ 371 Date: Aug. 27, 1998

§ 102(e) Date: Aug. 27, 1998

[87] PCT Pub. No.: WO97/33654

PCT Pub. Date: Sep. 18, 1997

[30] Foreign Application Priority Data

Mar. 11, 1996 [FI] Finland ..... 961128

[51] Int. Cl.[6] ..... A62C 35/00

[52] U.S. Cl. ..... 169/9; 169/13; 169/14; 169/15

[58] Field of Search ..... 169/5, 6, 9, 13, 169/14, 15, 71, 72, 78, 85; 141/63, 64, 67, 100, 105, 285, 301, 302; 222/61, 399, 464.1

[56] References Cited

U.S. PATENT DOCUMENTS

| | | | |
|---|---|---|---|
| 3,548,949 | 12/1970 | Groves et al. | 169/9 |
| 3,949,812 | 4/1976 | Hay | 169/43 |
| 4,981,178 | 1/1991 | Bundy | 169/9 |
| 5,607,020 | 3/1997 | Gebhardt | 169/48 |
| 5,632,338 | 5/1997 | Hunter | 169/9 |

FOREIGN PATENT DOCUMENTS

| | | |
|---|---|---|
| 2425252 | 12/1979 | France . |
| 1126304 | 11/1984 | U.S.S.R. . |

OTHER PUBLICATIONS

Abstract of SU1126304 of Nov. 1984.

*Primary Examiner*—Henry J. Recla
*Assistant Examiner*—Timothy L. Maust
*Attorney, Agent, or Firm*—Ladas & Parry

[57] ABSTRACT

A fire extinguishing system having a high pressure liquid accumulator unit (1') and a pump unit (2'). The high pressure liquid accumulator unit has at least one liquid bottle (4*a'*, 4*b'*) for extinguishing liquid, the liquid bottle being connected to a gas source (6*a'*, 6*b'*) through a gas supply line (5') and having an inlet aperture for reception of gas from the gas source. The pump unit has a pump (10') and drive (11') for driving the pump. A line (15') for feeding extinguishing liquid extends from the liquid bottle in order to provide spray heads (3) with extinguishing liquid and the pump is connected to the liquid bottle through a supply line (12') in order to provide the liquid bottle with liquid. In order to enable an effective and, as to the time, relatively long delivery of extinguishing liquid at high pressure with an essentially decreased risk of ice formation, the supply line (12') of the pump is connected to the gas supply line (5') of the gas source by a connecting space (13*a'*, 13*b'*).

13 Claims, 4 Drawing Sheets

FIRE EXTINGUISHING SYSTEM

BACKGROUND OF THE INVENTION

The present invention relates to a fire extinguishing system comprising a high pressure liquid accumulator unit and a pump unit, whereby the high pressure liquid accumulator unit comprises at least one liquid bottle for extinguishing liquid, which liquid bottle is connected to a gas source through a gas supply line and comprises an inlet aperture for reception of gas from the gas source, and the pump unit comprises a pump and driving means for driving the pump, whereby a line for feeding extinguishing liquid extends from the liquid bottle in order to provide spray heads with extinguishing liquid and the pump is connected to the liquid bottle through a supply line in order to be able to provide the liquid bottle with liquid. Such a fire extinguishing system is known from the international application with the publication number WO 95/07116.

Using hydraulic accumulators for delivering extinguishing medium has become more and more usual in the fire extinguishing technique. The hydraulic accumulator or accumulators are included in a high pressure liquid accumulator unit, the purpose of which is to deliver extinguishing liquid at high pressure to spray heads or sprinklers. One way of implementing a high pressure liquid accumulator is to connect a gas source to a liquid bottle containing extinguishing liquid, e.g. water. The gas source hereby generates a high pressure in the liquid bottle and presses extinguishing liquid out of the liquid bottle. The gas source consists of a nitrogen bottle, for instance.

It is of great significance for fire extinction that the extinguishing liquid has the right consistency and composition to be able to operate effectively at fire fighting. It is often essential that the drop size of the extinguishing liquid is very small in order that the extinguishing liquid may work effectively. In certain situations and environments, it is important that extinguishing liquid can be shot at high pressure several times.

When high pressure gas bottles are used for pressing extinguishing liquid out of liquid bottles, the extinguishing liquid is strongly cooled when it leaves the liquid bottle. In consequence of the extinguishing liquid being cooled, the whole system can be choked up so that no extinguishing medium can be delivered to the spray heads. Even if the system is not choked up, a negative effect is created in any case because of the fact that when the pressure gas is cooled, its force to drive out extinguishing liquid decreases, which can be fatal for the extinction.

SUMMARY OF THE INVENTION

The object of the present invention is to eliminate the problems associated with the known fire extinguishing systems comprising high pressure accumulators. To implement this, the fire extinguishing system according to the invention is characterized in that the supply line of the pump is connected to the gas supply line of the gas source through a connecting space. As to the structure, the connecting space can be provided in many different ways, and when gas bottles are used, this space makes it possible to drive all gas out of the bottle/bottles without the gas causing big drops and slow drop speed of the extinguishing medium at the final stage of emptying the gas bottle/bottles. The connection between the supply line of the pump and the gas supply line of the gas source is preferably performed in such a way that liquid and/or gas is fed into the liquid bottle at the connecting space (i.e. connection point) depending on the liquid pressure in the supply line of the pump or on the pressure in the gas supply line of the gas source, respectively. An automatic function of feeding medium into the water bottle and to the spray heads can be provided hereby. Preferred embodiments of the fire extinguishing system according to the invention are presented in the attached claims 2 to 11.

The greatest advantages of the present fire extinguishing system are that it enables an effective and, as to the time, relatively long delivery of extinguishing medium at high pressure with an essentially decreased risk of ice formation, whereby it is further possible to keep the drop size of the extinguishing liquid small and the drop speed high throughout the entire emptying. The risk of ice formation decreases especially when a high pressure pump is used. Thanks to the pump of the system, it is not necessary to use several sets of liquid bottles.

BRIEF DESCRIPTION OF THE DRAWINGS

In the following, the fire extinguishing system according to the invention is described by means of a few embodiments and with reference to the attached drawing, in which.

DESCRIPTION OF THE PREFERRED EMBODIMENTS

Figure 1:
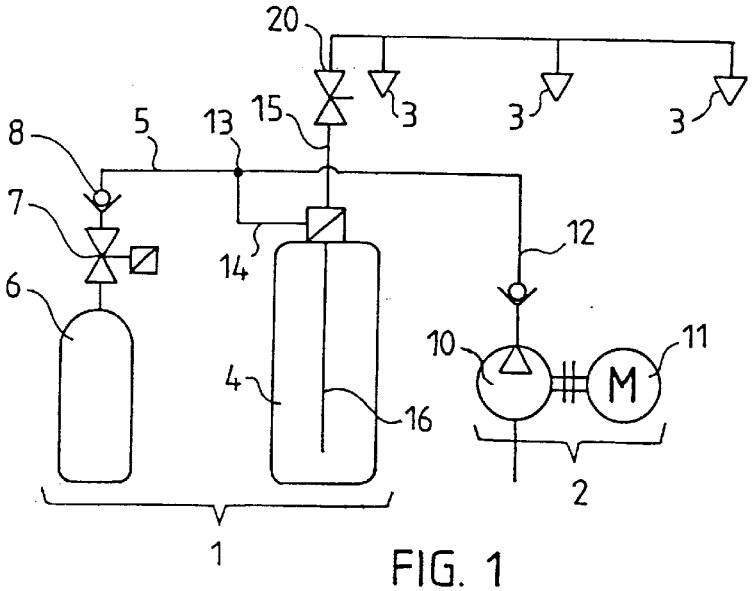
FIG. 1 illustrates a basic diagram of the present invention.

FIG. 1 shows the main components of a fire extinguisher enabling extinguishing liquid to be shot at high pressure to spray heads or sprinklers on one or several occasions. The system comprises a high pressure accumulator generally indicated by reference numeral 1, a pump unit generally indicated by reference numeral 2 and sprinklers denoted by reference numeral 3.

The high pressure accumulator 1 consists of a liquid bottle 4 connected to a gas bottle 6 by means of a supply line 5. The liquid bottle 4 contains water. The gas bottle 6 contains nitrogen gas. The maximum pressure in the gas bottle 6 can preferably be within 40 to 300 bar. Reference numeral 7 indicates a valve and reference numeral 8 a non-return valve. The supply line 5 is connected to an inlet 9 or inlet aperture of the water bottle 4, see FIG. 2.

The pump unit 2 consists of a pump 10 and a motor 11, e.g. an electric motor or a hydraulic motor driving the pump 10. The pump is preferably a high pressure pump 10 having an operating pressure of 20 to 300 bar. Alternatively, a low pressure pump having an operating pressure of 5 to 20 bar could be used. The pump unit 2 is connected to a water (distribution) network.

From FIG. 1 it is seen that a supply line 12 extends from the pump 10, which line joins the supply line 5 of the gas bottle 6. From the meeting point 13 of the supply lines 5 and 12, a common line 14 leads to the inlet of the water bottle 4. Accordingly, the line 14 is part of the supply lines 5 and 12.

Reference numeral 15 indicates a line, which provides the sprinklers 3 with extinguishing liquid through a valve 20.

Reference numeral 16 indicates a rising tube in the water bottle.

The system according to FIGS. 1 and 2 works as follows.

When a fire is detected, the pump unit 2 is started and water is led initially through the supply line 12 and the line 15 to the sprinklers 3. Subsequently, the valve 7 is opened and gas starts flowing from the gas bottle 6 through the supply line 5 into the water bottle 4. The high pressure generated by the gas bottle 6 drives water out of the water bottle 4 at high pressure. This "shooting" of water at high pressure through the line 15 to the sprinklers 3 is going on during a desired period. When shooting, the pressure in the gas bottle 6 decreases. After the pressure has fallen below the value the pump unit 2 is able to provide, the pump unit drives water into the water bottle 4 and via this through the line 15 to the sprinklers 3. If desired, the valve 7 can be closed after a relatively short shooting, and then the pump unit 2 can fill the water bottle 4 with water. Subsequently, the valve 7 can be opened again for another shooting at high pressure.

Figure 2:
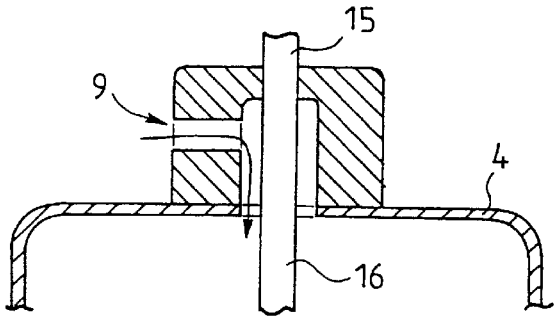
FIG. 2 shows a detail of FIG. 1.

It is to be understood from FIGS. 1 and 2 that the water coming through the lines 12 and 14 and filling the water bottle 4 is able to heat up the rising tube 16 and the bottle 4, and accordingly, to prevent the rising tube from freezing. The more water is fed, the more is compensated for the temperature drop caused by the shootings at high pressure in the water bottle 4. On the basis of said heating, a higher effect for fire extinction can also be gained by the gas.

Figure 3:
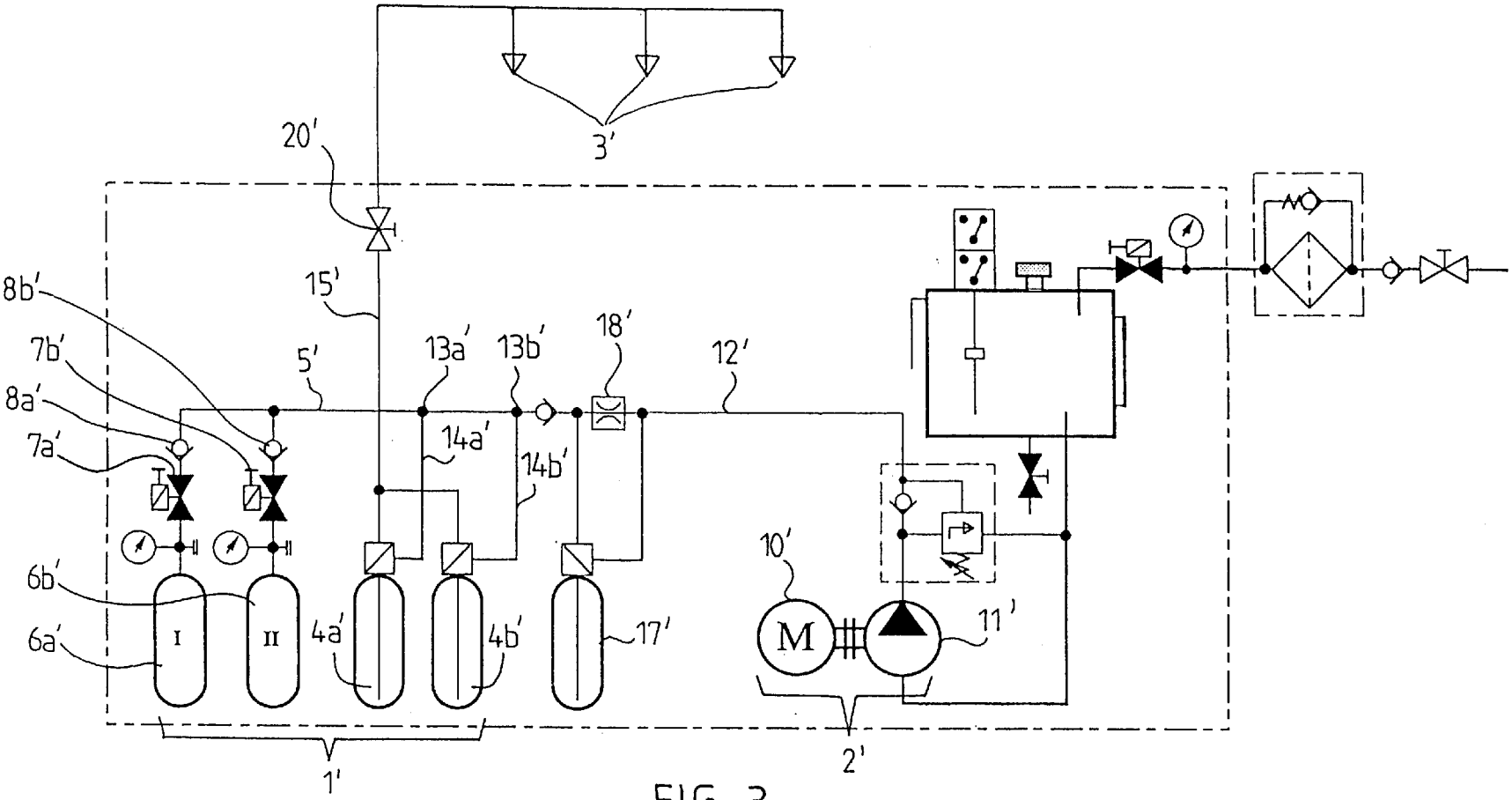
FIG. 3 shows a preferred embodiment of the invention.

FIG. 3 shows a preferred embodiment of the invention. In FIG. 3, analogous reference numerals are used for analogous components in FIG. 1.

FIG. 3 differs from FIG. 1 therein that there are two sets of gas bottles 6*a*' and 6*b*'. The number of gas bottles in each set can vary according to requirements. The gas bottles 6*a*' and 6*b*' are connected in parallel. The embodiment in FIG. 3 shows two water bottles connected in parallel. It is, however, obvious that the number of water bottles can vary.

The embodiment of FIG. 3 shows additionally a container 17' including foam concentrate. Reference numeral 18' indicates a throttling making the foam concentrate mix with the water when it is transported from the pump unit 2' to the high pressure accumulator unit 1'. The throttling 18' provides a pressure loss of 2 to 6 bar, preferably 4 bar. With a pressure difference of e.g. 4 bar in the throttling, the foam concentrate is pressed out of the container 17' and mixed with the water flow of the pump unit 2' and into the water bottles 4*a*', 4*b*' and further into the line 15'. It is especially preferable to use foam concentrate for increasing the effect of extinction in case of small fires.

The embodiment of FIG. 3 operates in a manner corresponding to the embodiment of FIG. 1. Since the embodiment of FIG. 3 has two sets of gas bottles 6*a*' and 6*b*', it is very easy to implement two shootings at high pressure: a first shooting is performed by means of the set of gas bottles 6*a*' after which the pump unit 2' fills the water bottles 4*a*' and 4*b*' with water, and subsequently, a second shooting is performed by means of the set of gas bottles 6*b*'. If the pump 10' is of high pressure type, the filling process of the bottles 4*a*', 4*b*' starts automatically successively after a sufficient pressure drop in the gas bottle 6*a*'. If a low pressure pump is used, the filling process starts after the pressure in the gas bottle 6*a* has fallen below the set pressure value of the pump.

Figure 7:
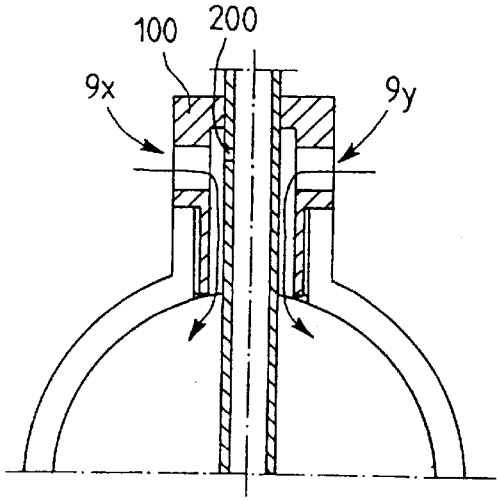
FIG. 7 shows a way of connecting gas and liquid to the liquid bottle, which way is alternative to FIG. 2 and corresponds to the connection in FIG. 4.
Figure 4:
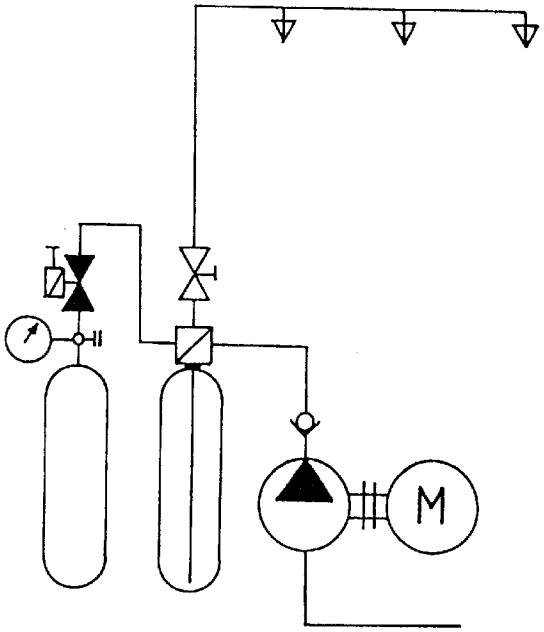

FIG. 4 shows an embodiment, in which the water and the gas go into the water bottle in the side of an intake portion 100. FIG. 7 illustrates the connection in FIG. 4 at the liquid bottle. Reference numeral 9*x* indicates the gas inlet and reference numeral 9*y* the liquid inlet. In FIG. 7, reference numeral 200 indicates openings in the riser for taking out gas when the water bottle is filled with water.

Figure 5:
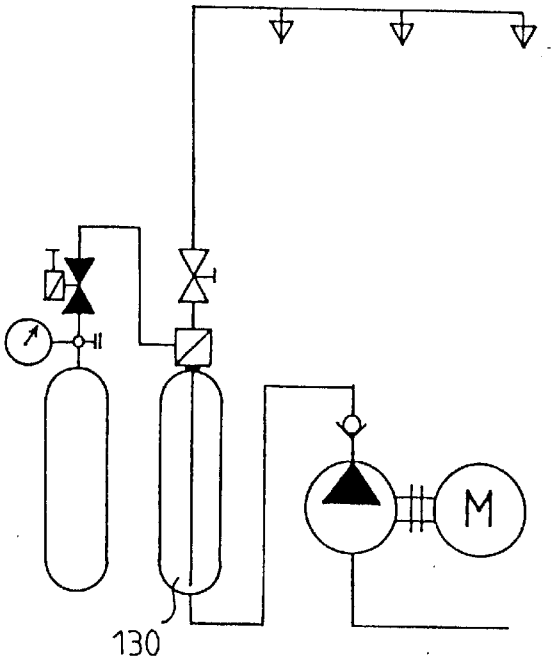

FIG. 5 shows an alternative embodiment, in which water flows from the bottom through the supply line of the pump into the water bottle. The connecting point or space for the supply line of the pump and the gas supply line of the gas bottle is indicated by reference numeral 130.

Figure 6:
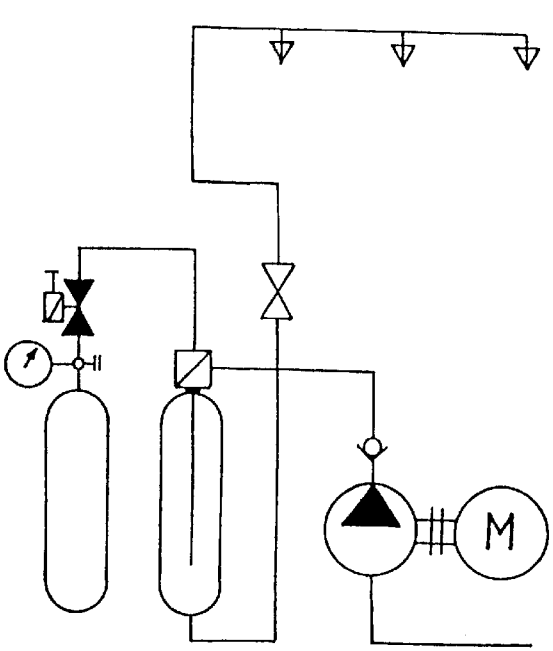
FIGS. 4 to 6 show three alternative ways of connecting the gas bottle and the pump unit to the liquid bottle.

FIG. 6 shows an alternative embodiment, in which the line bringing extinguishing liquid to the sprinklers extends from the bottom of the water bottle. The gas flows into the rising tube, which has openings in the side. The gas passes the water in the water bottle.

Figure 8:
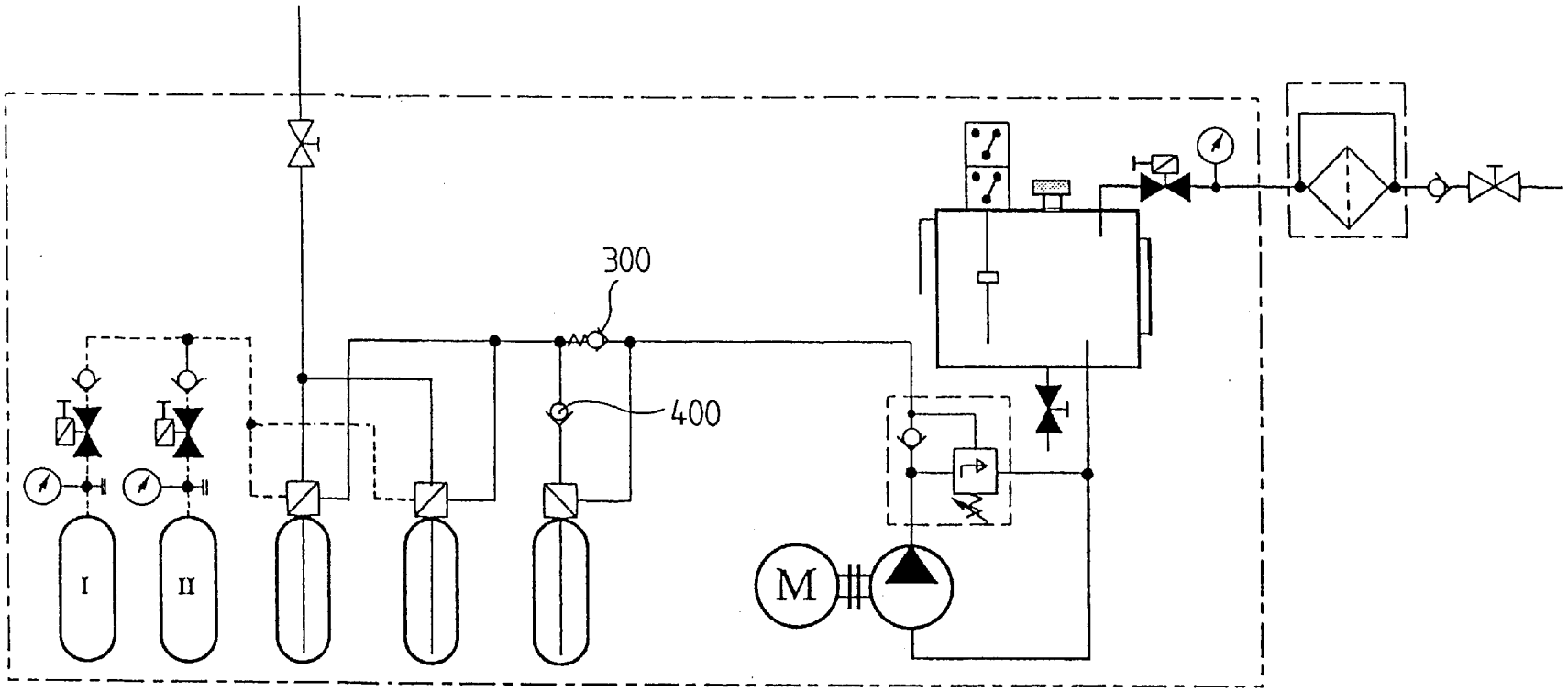
FIG. 8 shows an alternative to FIG. 3.

FIG. 8 shows an embodiment alternative to the embodiment of FIG. 3. It can be seen that the throttle 18' of FIG. 3 has been changed for a valve 300. The pressure drop over the valve 300 is preferably 2 to 6 bar, e.g. about 4 bar. The embodiment of FIG. 8 has further a non-return valve 400 connected between the foam concentrate container and the water bottles.

The invention has been described above by means of examples only, and therefore, it is pointed out that the details of the invention can vary in many ways within the scope of the idea according to the invention and the facts set forth in attached claim 1. Here it is, for instance, possible to use instead of a gas bottle a gas source of another type. The connection means connecting the supply line of the pump unit and the supply line of the gas source together can vary: for instance, separate supply lines from the pump unit and the gas source can lead to the liquid bottle and are not joined until in the liquid bottle. The gas does not need to be nitrogen gas, but it can be e.g. air or inert gas and the extinguishing liquid does not need to be absolutely water, even if water is to prefer. The expression "liquid bottle" signifies any type of liquid container, of course. The number of gas bottles and sets of gas bottles may vary, as mentioned before.

I claim:

1. Fire extinguishing system comprising a high pressure liquid accumulator unit (1, 1') and a pump unit (2, 2'), whereby the high pressure liquid accumulator unit comprises at least one liquid bottle (4, 4*a*', 4*b*') for extinguishing liquid, which liquid bottle is connected to a gas source (6, 6*a*', 6*b*') through a gas supply line (5, 5') and comprises an inlet aperture (9, 9*x*) for reception of gas from the gas source, and the pump unit comprises a pump (10, 10') and driving means (11, 11') for driving the pump, whereby a line (15, 15') for feeding extinguishing liquid extends from the liquid bottle in order to provide spray heads (3) with extinguishing liquid and the pump is connected to the liquid bottle through a supply line (12, 12') in order to be able to provide the liquid bottle with liquid, characterized in that the supply line (12, 12') of the pump (10, 10') is connected to the gas supply line (5, 5') of the gas source (6, 6*a*', 6*b*') through a connecting space (13, 13*a*', 13*b*', 130).

2. Fire extinguishing system according to claim 1, characterized in that the connection between the supply line (12, 12') of the pump and the gas supply line (5, 5') of the gas source is performed in such a way that liquid and/or gas is fed into the liquid bottle (4, 4*a*', 4*b*') at the connecting space (13, 13*a*', 13*b*', 130), depending on the liquid pressure in the supply line (12, 12') of the pump and on the pressure in the gas supply line (5, 5') of the gas source, respectively.

3. Fire extinguishing system according to claim 1, characterized in that the gas source comprises at least one gas bottle (6, 6*a*', 6*b*').

4. Fire extinguishing system according to claim 3, characterized in that the gas source comprises two sets of gas bottles (6*a*', 6*b*') connected in parallel, each set comprising a valve (7*a*' or 7*b*', respectively) for enabling emptying of the sets one after the other.

5. Fire extinguishing system according to claim 1, characterized in that the gas bottle (6, 6*a*', 6*b*') contains nitrogen gas.

6. Fire extinguishing system according claim 1, characterized in that the gas bottle (6, 6*a*', 6*b*') contains air.

7. Fire extinguishing system according to claim 5, characterized in that the pressure in the gas bottle (6, 6*a*', 6*b*') is 40 to 300 bar.

8. Fire extinguishing system according to claim 1, characterized in that the liquid bottle is a water bottle (4, 4*a*', 4*b*').

9. Fire extinguishing system according to claim 1, characterized in that the pump is a high pressure pump (10, 10').

10. Fire extinguishing system according to claim 9, characterized in that the pump (10, 10') has an operating pressure of 20 to 300 bar.

11. Fire extinguishing system according to claim 1, characterized in that a foam concentrate container (17') is connected in series with the pump unit (2') and the liquid bottle (3*a*', 3*b*') between the pump unit and the liquid bottle.

12. Fire extinguishing system according to claim 2, characterized in that the gas source comprises at least one gas bottle (6, 6*a*', 6*b*').

13. Fire extinguishing system according to claim 12, characterized in that the gas source comprises two sets of gas bottles (6*a*', 6*b*') connected in parallel, each set comprising a valve (7*a*' or 7*b*', respectively) for enabling emptying of the sets one after the other.

* * * * *